US007377215B2

(12) United States Patent
Chen

(10) Patent No.: US 7,377,215 B2
(45) Date of Patent: May 27, 2008

(54) STRUCTURE OF PATTERN PRESSING ROLLER

(76) Inventor: Jung Chi Chen, No.8, Lane 289, Sihu St., Yingge Township, Taipei County (TW)

( * ) Notice: Subject to any disclaimer, the term of this patent is extended or adjusted under 35 U.S.C. 154(b) by 401 days.

(21) Appl. No.: 11/209,051

(22) Filed: Aug. 23, 2005

(65) Prior Publication Data

US 2007/0051252 A1 Mar. 8, 2007

(51) Int. Cl.
*B41F 19/02* (2006.01)

(52) U.S. Cl. ..... 101/3.1; 101/36

(58) Field of Classification Search ..... 101/4–6, 101/3.1, 28, 33, 35, 36
See application file for complete search history.

(56) References Cited

U.S. PATENT DOCUMENTS 3,042,996 A * 7/1962 Nelson ..... 29/895.3
4,248,117 A * 2/1981 Bugnone ..... 83/863
5,732,585 A * 3/1998 Haushahn et al. ..... 72/210
6,188,229 B1 * 2/2001 Nakamura ..... 324/695
2003/0110961 A1 * 6/2003 Bredahl et al. ..... 101/3.1
2004/0051948 A1 * 3/2004 Reed ..... 359/529
2005/0008825 A1 * 1/2005 Casey et al. ..... 428/174

* cited by examiner

*Primary Examiner*—Anthony H. Nguyen
(74) *Attorney, Agent, or Firm*—Morris, Manning & Martin, LLP; Tim Tingkang Xia, Esq.

(57) ABSTRACT

A structure of pattern pressing roller comprises a shaft and a plurality of pattern pressing loops suitable for slipping onto the shaft, wherein each loop consists carved pattern on its surface. The pattern pressing loops are slipped onto the shaft, and they are aligned and located tightly against each other and onto the shaft so that when the shaft is in the rotation motion, the pattern pressing loops are moved together with the shaft in one motion. When one or more of the pattern pressing loops is required to be repaired due to damages or weariness on its surface, the pattern pressing loops can be removed away from the shaft or a new one is replaced the damaged one quickly and easily.

15 Claims, 5 Drawing Sheets

STRUCTURE OF PATTERN PRESSING ROLLER

BACKGROUND OF THE INVENTION

1. Field of Invention

The present invention relates generally to a structure of pattern pressing roller suitable for pressed printing on the cardboards. More particularly, the present invention relates to a structure of pattern pressing roller that can provide various patterns or diagrams on the cardboards through the pressed printing process.

2. Description of the Related Art

The patterns on the cardboard are pressed-printed by the pattern pressing roller comprising the corresponding pattern on its surface. In other words, the patterns on the cardboards will be various according to the carved patterns on the surfaces of the rollers.

The conventional fabrication of the patterns on the cardboard usually provides some straight lines or wave line patterns. Since the cardboards cannot generally subject to the compressing pressure process, therefore, the thickness on the cardboards is increased in order to improve its hardness so that it can provide some resistance toward the pressing pressure.

The hardness of the cardboards is the main problem that is well known in the prior art, a lot people in this field have tried to find different ways to resolve the problem. In recent years, the hardness of the cardboards is gradually improved. It is an object of the invention to provide a pattern pressing roller that can improve the hardness of the cardboards based on inventive ideas of the inventor, his years of experiences in this field. In order to pressed print a desired pattern onto the cardboards, the pattern pressing roller must consists the desired pattern. The pattern is normally carved through the carving equipment to sculpt onto the surface areas of the roller in order to produce the desired pattern onto the surface of the roller. However, a lot of these patterns are complex with highly density of patterns or drawings that the accuracy of producing those complex patterns is very difficult. Particularly, a weariness problem is normally occurred during the carving process. Further, if those conventional carving equipments of the pattern pressing roller have not been through a heat process to increase its hardness in the first place, then once the patterns are completed on the roller and those pattern pressing roller goes through a heat process, the patterns or the size of the patterns on the roller will be distorted due to the heat. To repairing or re-sculpt those distorted patterns becomes very difficult, the cost and time are consuming. Thus, the efficiency of the fabrication is reduced.

During the pressing process, those patterns on the surfaces of the pattern pressing rollers will eventually wear out due to the surface friction. But the conventional pattern pressing rollers are difficult and costly to repair or re-carve its patterns on the surface of the rollers. Unless the patterns are very badly to be seen or distorted badly, otherwise it is not wise to increase the production cost by repairing or replacing the damaged rollers frequently. It is understandable that in such condition, the pressing quality is not very good due to the cost and inconvenience. Further, the repairing process is lengthy and inconvenient, so it induces another problem in the production process.

SUMMARY OF THE INVENTION

It is an object of the present invention to provide an improving structure of pattern pressing roller can prevent those problems occurred utilizing the conventional pattern pressing rollers. The present invention provides an improving structure of pattern pressing roller that can be assembled or disassembled easily. The pattern pressing roller of the present invention can be fabricated each component separately, once all the components are completed, then they can be assembled together to form the structure. The high accuracy or the high density of the patterns on the surfaces of the roller can be achieved. If any part of the structure of pattern pressing roller is damaged, it can be separated easily and be repaired or replaced quickly without any difficulty.

As mentioned above that the present invention provides a structure of pattern pressing roller that can be assembled and disassembled easily. The present invention provides an improving structure of pattern pressing roller comprising a shaft and a plurality of pattern pressing loops. The fabrication of the pattern pressing roller of the present invention is fairly easy. When one or more of the pattern pressing loops is required to be repaired due to damages or weariness on its surface, the pattern pressing loops can be removed away from the shaft. Once the damaged one is replaced with new one, the pattern pressing roller of the present invention can be utilized.

These and other objects of the present invention will become readily apparent upon further review of the following specification and drawings.

BRIEF DESCRIPTION OF THE DRAWING

The accompanying drawings are included to provide a further understanding of the present invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
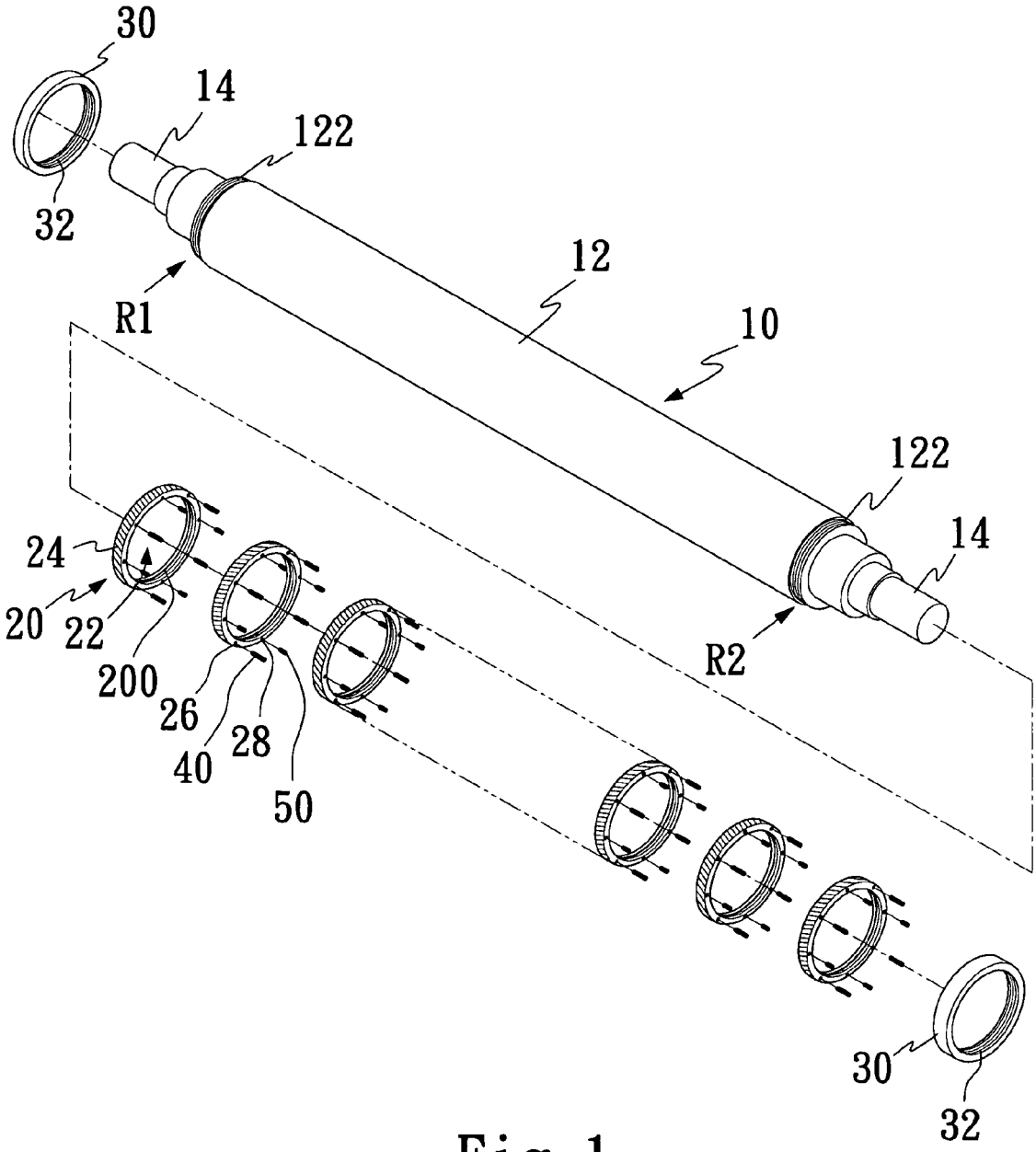
FIG. 1 is a 3-D assembled view of a structure of pattern pressing roller in accordance with a preferred embodiment of the present invention.
Figure 2:
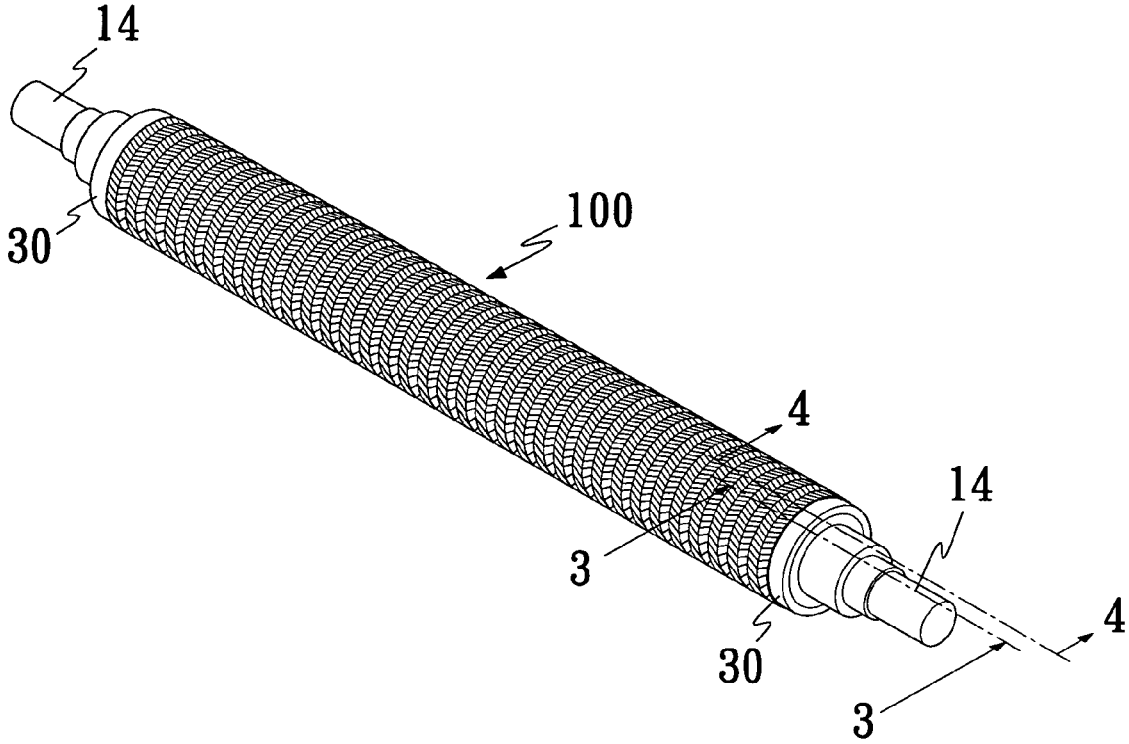
FIG. 2 illustrates a 3-D view of an assembled structure of pattern pressing roller in accordance with a preferred embodiment of the present invention

FIG. 1 shows a 3-D assembled view of a structure of pattern pressing roller in accordance with a preferred embodiment of the present invention. FIG. 2 illustrates an 3-D view of an assembled structure of pattern pressing roller in accordance with a preferred embodiment of the present invention. The pattern pressing roller of the present invention comprises a shaft 10, a plurality of pattern pressing loops 20 and two secured rings 30, wherein the pattern pressing loops 20 can be inserted onto a middle portion 12 of the shaft 10. Once all the patter pressing loops 20 are located within the shaft 10, the two secured rings 30 are utilized to secure the pattern pressing loops 20 by inserting into both ends of the shaft 10 respectively. The two secured rings 30 are utilized to compress those patter pressing loops 20 tightly against each other in order to prevent any one of them coming off from the shaft 10.

The shaft 10 can be made of various kinds of carbon steel materials or any suitable material that is passed a hardness test. The shaft 10 comprises the middle portion 12 and two end portions 14 The middle portion 12 of the shaft 10 is utilized to locate those pattern pressing loops 20, wherein the two end portions 14 are utilized for rotating the shaft 10 by receiving the initiating power from outside. An outer diameter of the middle portion 12 of the shaft 10 is big enough for inserting the pattern pressing loops 20. Screw-pattern parts 122 are formed at both side of the middle portion 12 of the shaft 10 shown in FIG. 1. The screw-pattern parts 122 are matched and combined with pattern portions 32 of two secured ring 30 in order to provide a locking effect to secure those pattern pressing loops 20 from both sides of the shaft 10. Once those pattern pressing loops 20 are secured by locking the two secured rings 20 onto the screw-pattern parts 122 of the shaft 10, the pattern pressing loops 20 cannot deviate from the shaft 10.

The pattern pressing loops 20 can be inserted onto the shaft 10 simultaneously, and the pattern pressing loops 20 will rotate according to the movement of the shaft 10. The holes 22 of the pattern pressing loops 20 are inserted tightly onto the shaft 10, wherein carved patterns 24 are sculpted on surfaces of the pattern pressing loops 20 in order to imprinted those corresponding patterns on surface of the cardboard. From FIG. 2, the patter pressing loops 20 are located closed to each other to form a continuous surface pattern 100 on the shaft 10.

Figure 3:
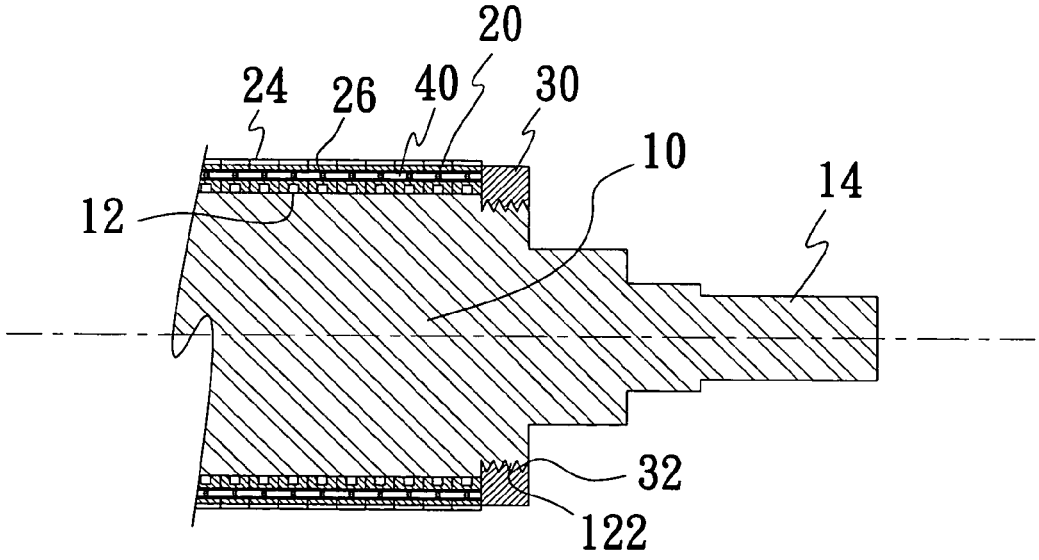
FIG. 3 is a cross-sectional view of a portion of FIG. 2 along the line 3-3

FIG. 3, shows a portion of a cross-sectional view of FIG. 2. Once all the pattern pressing loops 20 are assembled onto the shaft 10, the carved patterns 24 of the pattern pressing loops 20 are aligned properly to form a prefect pattern. In order to prevent various problems occur to those pattern pressing loops 20 during the rotation process when the shaft 10 is rolling, a plurality of positioning rods 40 are utilized to insert into positioning holes 26 which are formed on pattern pressing loops 20 so that the carved patterns 24 of the pattern pressing loops 20 can be assembled together. The connection through the positioning rods 40 can ensure that the pattern pressing loops 20 are rotated in accordance with the movement of the shaft 10. In FIG. 3, the positioning rods 40 can be objects that contain screw-pattern on their surface areas, such as screws, so that the screw-pattern surfaces are corresponding to the surfaces of those positioning holes 26 to create a locking effect.

Figure 4:
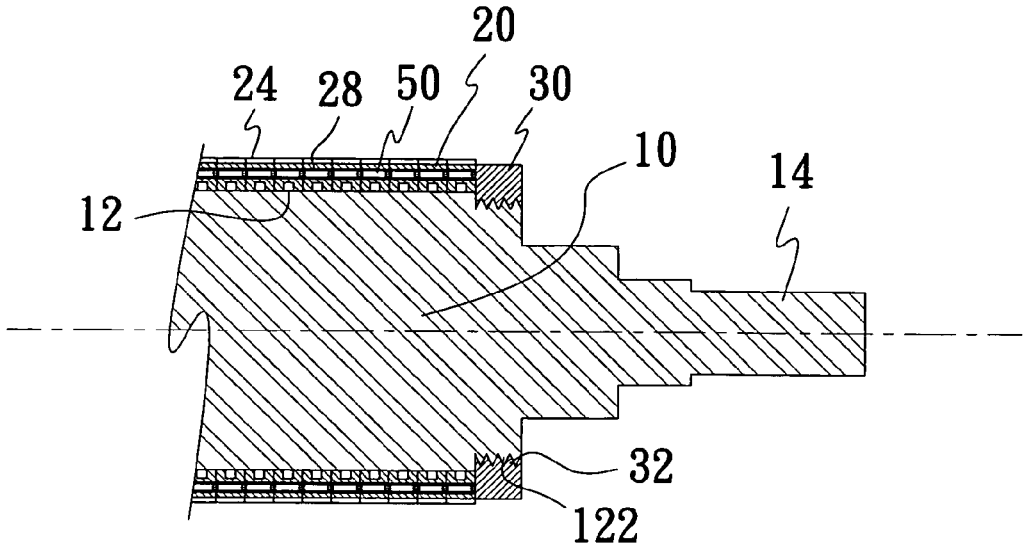
FIG. 4 is a cross-sectional view of a portion of FIG. 2 along the line 4-4

From the diagrams, a slot 28 is formed on a side surface of the pattern pressing loops 20 for locating a pin 50. Refer to FIG. 4, the pin 50 comprises a screw-pattern on its outer surface area, corresponding to a screw-pattern formed on an internal surface area of the slot 28 of the pattern pressing loops 20 so that once the pin 50 is located within the slot 28, it is being locked. The main purpose of design of the pin 50 is to provide some assistance to separate those closed tightly pattern pressing loops 20 on the shaft 10 such as when one of the pattern pressing loops 20 is damaged and is required to be repaired, the pin 50 can be utilized by pushing out the pin 50 from the surface of the pattern pressing loops 20 in order to separate the pattern pressing loops 20.

From the above-mentioned descriptions of the present invention, there are some objects of the present invention required to be elaborated. In order to allow one or more of the pattern pressing loops 20 removing from or assembling onto the shaft 10, there are two different size of diameters formed on the shaft 10 as shown on FIG. 1. R1 and R2 are formed on both ends of the middle portion 12 of the shaft 10, wherein R1 has larger diameter than R2 so that the both ends of the middle portion 12 of the shaft forms slightly a conical shape. As a matter of fact, every hole 22 of the pattern pressing loop 20 is matched to the outer diameter of the middle portion 12 of the shaft 10 so that every patter pressing loop 20 is inserted tightly onto the middle portion 12 of the shaft 10.

On the hand, from diagrams 1, 3 and 4, a trench pattern 200 is fabricated on an internal surface of every pattern pressing loop 20 in order to reduce the friction between the pattern pressing loops 20 and the shaft 10 during the assembling process. The design of the holes 22 of the pattern pressing loops 20 and the middle portion 12 of the shaft 10 are not limited or restricted to the circular shape. Various shapes can be utilized to design those components. The drawings show that although the holes 22 of the pattern pressing loops 20 and the middle portion 12 of the shaft 10 can be formed into circular shapes, but the pattern pressing loops 20 will not induce spinning freely or rotating delayed when the shaft 10 is in a rolling movement. One of the main reasons is that the shaft 10 is proceeded through a cooling process before those pattern pressing loops 20 are inserted onto the shaft 10. So once the shaft 10 is at a normal room temperature, it expands its diameter to compress those pattern pressing loops 20 tightly against its body such as the middle portion 12 of the shaft 10. Thus, the pattern pressing loops 20 are so tightly compressed onto the shaft 12 that it forms as one whole structure so when the shaft 10 is in a rolling motion, the pattern pressing loops 20 will move simultaneously with the shaft 10. Due to the tightly connection between the pattern pressing loops 20 and the shaft 10 that the assembled structure is required to go through another cooling process if any one of the pattern pressing loops 20 is required to be removed away from the shaft 10.

Figure 5:
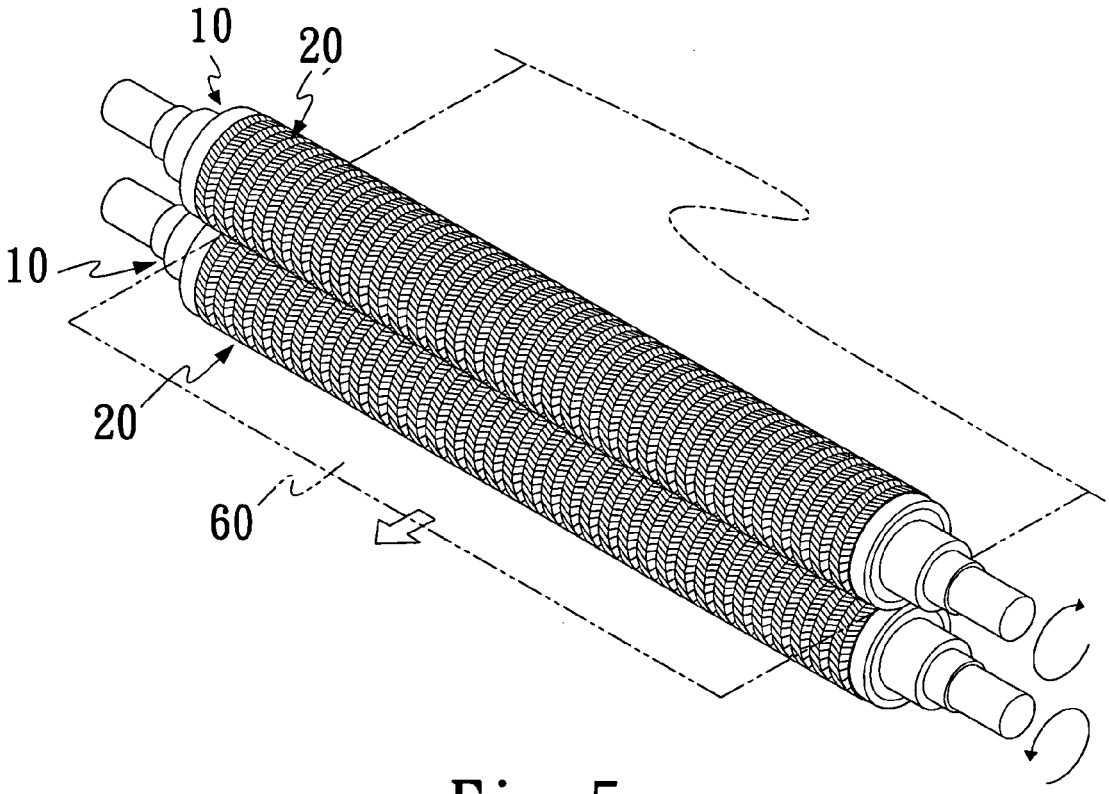
FIG. 5 is a 3-D view of pressing process utilizing the pattern pressing rollers in accordance with a practical preferred example of the present invention
Figure 6:
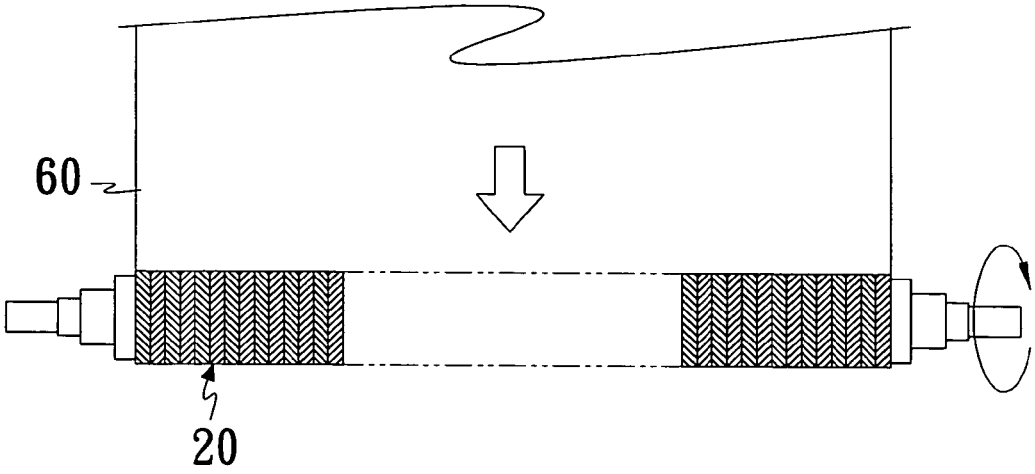
FIG. 6 is a partial front view of those patterns formed on the surface area of the pattern pressing roller of the present invention
Figure 7:
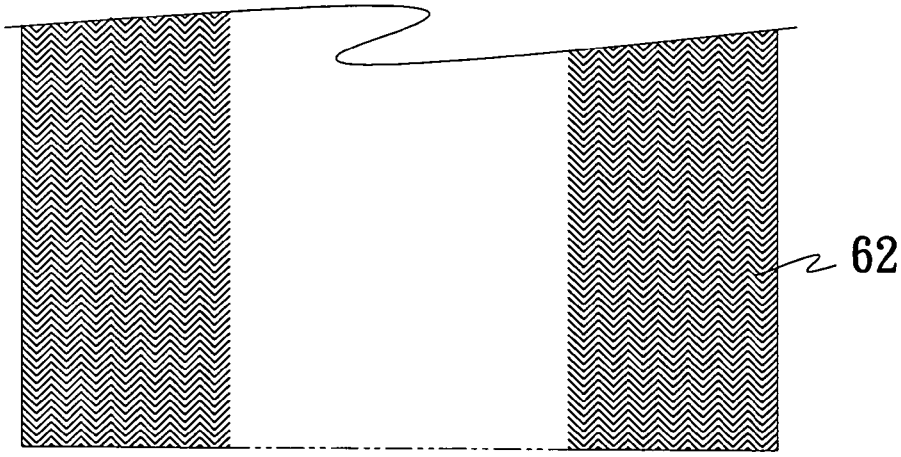
FIG. 7 is a view of a cardboard after pressed printing by the pattern pressing roller in FIG. 6
Figure 8:
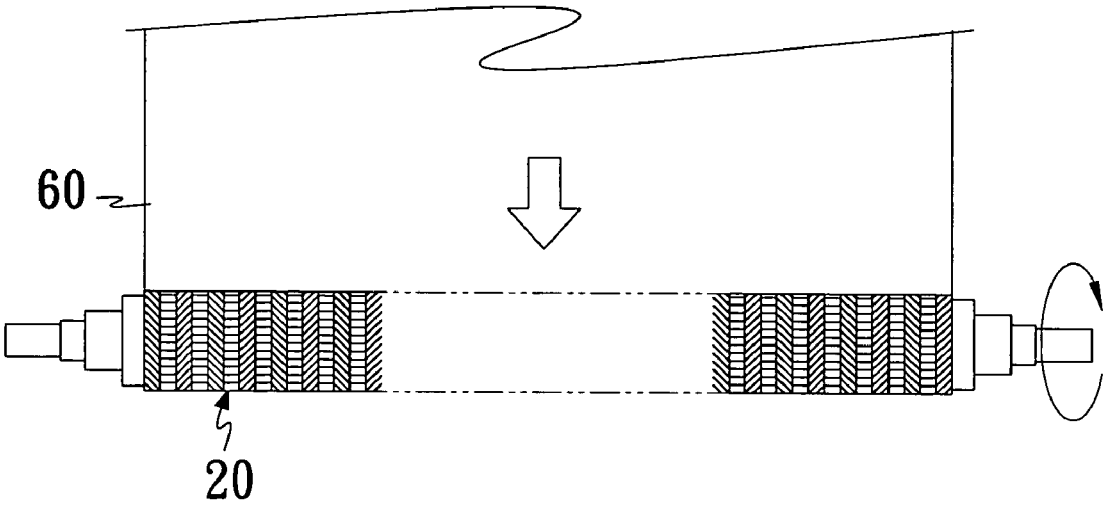
FIG. 8 is a front view of showing another type of pattern of a pattern pressing roller in accordance with a preferred example of the present invention
Figure 9:
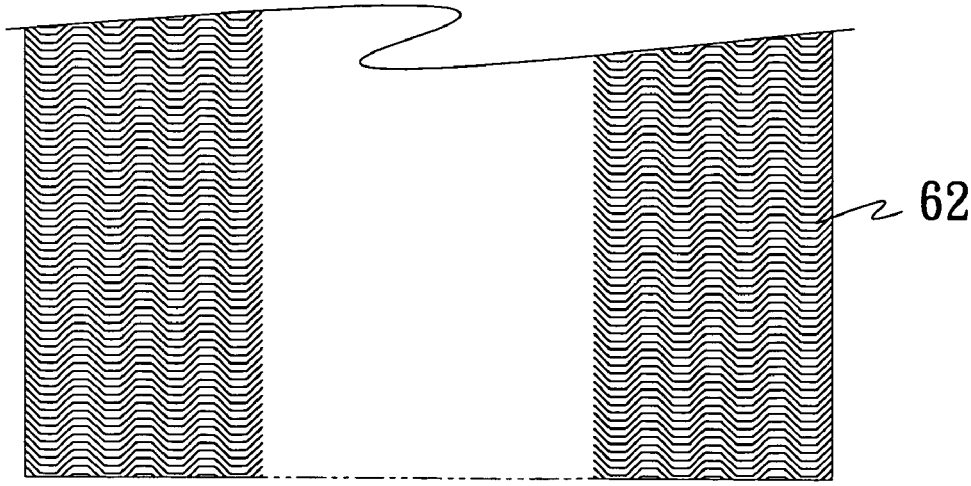
FIG. 9 is a view of a cardboard after pressed printing by the pattern pressing roller in FIG. 8

FIG. 5 shows an environmental view of a structure of a pattern pressing roller in accordance with a preferred practical example of the present invention. A plurality of pattern pressing loops 20 assembled on the shaft 10 provide a pressing pattern on the cardboard 60. From FIGS. 1-8, various pattern designs can be formed on the surface areas of the pattern pressing loops 20 to fulfill the requirements on the cardboards 60. FIGS. 7 and 9 show that different pattern designs 62 can be varied on the surfaces of the cardboards 60 once the cardboards 60 is press-printed by the pattern pressing roller of the present invention.

As mentioned above that the present invention provides a structure of a pattern pressing roller that can be assembled and disassembled easily. The fabrication of the pattern pressing roller of the present invention is fairly easy, and when one or more of the pattern pressing loops 20 is required to be repaired due to damages or weariness on its surface, the pattern pressing loops 20 can be removed away from the shaft. Once the damaged one is replaced with new one, the pattern pressing roller of the present invention can be utilized.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A structure of pattern pressing roller, comprising:

a shaft being movable in a rotation motion and having a first end portion and an opposite, second end portion defining a middle portion therebetween, wherein each of the first and second end portions has a step-like structure, and wherein the middle portion has an exterior surface, a first threaded portion and a second threaded portion formed on the exterior surface at a first end, an opposite, second end of the middle portion, respectively; and a plurality of pattern pressing loops, wherein each loop has an interior surface and an exterior surface defining a loop body therebetween, and a carved pattern formed on its exterior surface, wherein as assembled, the pattern pressing loops are silded onto the shaft, aligned and located tightly against each other onto the middle portion of the shaft such that when the shaft is in the rotation motion, the pattern pressing loops are moved together with the shaft in the rotation motion, thereby, forming a continuous pattern surface.

2. The structure of claim 1, wherein the first and second end portions of the shaft are configured to receive outer power in order to initiate the rotation motion of the shaft.

3. The structure of claim 2, further comprising two secured rings, each secured ring having a threaded portion formed on its interior surface for threading onto a corresponding one of the first and second threaded portions of the middle portion of the shaft for securing the pattern pressing loops thereon.

4. The structure of claim 2, wherein the loop body of each pattern pressing loop defines an opening such that the pattern pressing loops are slidable tightly onto the middle portion of the shaft.

5. The structure of claim 4, wherein each pattern pressing loop further has a trench-pattern formed on its internal surface for reducing friction between the shaft and the pattern pressing loop.

6. The structure of claim 1, wherein each pattern pressing loop further has at least one positioning hole formed on the loop body such that as assembled, a positioning rod is utilized to pass through the at least one positioning hole so as to lock the pattern pressing loops in place.

7. The structure of claim 1, further comprising at least one pin utilized to position and assemble the pattern pressing loops, the at least one pin being capable of separating a single pattern pressing loop from the remaining pattern pressing loops by pushing the at least one pin out a surface area of the single pattern pressing loop.

8. The structure of claim 7, wherein each pattern pressing loop further has at least one slot formed for positioning the at least one pin.

9. The structure of claim 8, wherein the at least one pin has a screw-pattern formed on its outer surface, and wherein the at least one slot has a corresponding screw-pattern formed on its internal surface so that the at least one pin is screwable into the at least one slot for securing the pattern pressing loops.

10. A pattern pressing roller comprising:

a shaft, being movable in a rotation motion and having a first end portion and an opposite, second end portion defining a middle portion therebetween, wherein the middle portion has an exterior surface, a first threaded portion and a second threaded portion formed on the exterior surface at a first end, an opposite, second end of the middle portion, respectively, wherein the middle portion of the shaft is sized with a diameter R1 and each of the first end portion and the second end portion is sized with a diameter R2, and wherein R1 is bigger than R2; and a plurality of pattern pressing loops, wherein each loop has an interior surface and an exterior surface defining a loop body therebetween, and a carved pattern formed on its exterior surface, wherein as assembled, the pattern pressing loops are silded onto the middle portion of the shaft, aligned and located tightly against each other onto the middle portion of the shaft such that when the shaft is in the rotation motion, the pattern pressing loops are moved together with the shaft in the rotation motion, thereby, forming a continuous pattern surface, wherein holes are formed on the pattern pressing loops so that the pattern pressing loops can be located tightly onto the middle portion of the shaft.

11. The structure of claim 10, further comprising two secured rings, each secured ring having a threaded portion formed on its interior surface for threading onto a corresponding one of the first and second threaded portions of the middle portion of the shaft for securing the pattern pressing loops thereon.

12. The structure of claim 10, wherein each pattern pressing loop further has at least one positioning hole formed on the loop body such that as assembled, a positioning rod is utilized to pass through the at least one positioning hole so as to lock the pattern pressing loops in place.

13. The structure of claim 10, further comprising at least one pin utilized to position and assemble the pattern pressing loops, the at least one pin being capable of separating a single pattern pressing loop from the remaining pattern pressing loops by pushing the at least one pin out a surface area of the single pattern pressing loop.

14. The structure of claim 13, wherein each pattern pressing loop further has at least one slot formed for positioning the at least one pin.

15. The structure of claim 14, wherein the at least one pin has a screw-pattern formed on its outer surface, and wherein the at least one slot has a corresponding screw-pattern formed on its internal surface so that the at least one pin is screwable into the at least one slot for securing the pattern pressing loops.

* * * * *